US005507441A

United States Patent [19]

De Boef et al.

[11] Patent Number: 5,507,441

[45] Date of Patent: Apr. 16, 1996

[54] SWINGING HAMMER FOR A MATERIAL REDUCING MACHINE

[75] Inventors: Duane R. De Boef, New Sharon; Jeff A. Fleenor, Pella; Thomas J. Kurt, Ames, all of Iowa

[73] Assignee: Vermeer Manufacturing Company, Pella, Iowa

[21] Appl. No.: 177,212

[22] Filed: Jan. 4, 1994

[51] Int. Cl.[6] ..... B02C 23/16; B02C 23/02; B02C 13/28

[52] U.S. Cl. ..... 241/73; 241/186.3; 241/194; 241/195

[58] Field of Search ..... 241/195, 197, 241/194, 292.1, 294, 300, 73, 186.3

[56] References Cited

U.S. PATENT DOCUMENTS

| | | | |
|---|---|---|---|
| 3,917,179 | 11/1975 | Graf . | |
| 4,311,284 | 1/1982 | Ratcliff, Jr. | 241/295 X |
| 4,344,581 | 8/1982 | Redemann | 241/195 X |
| 4,585,180 | 4/1986 | Potts | 241/188.1 X |
| 5,114,085 | 5/1992 | Inui | 241/195 |
| 5,332,164 | 7/1994 | Page | 241/288.3 X |

FOREIGN PATENT DOCUMENTS

| | | | |
|---|---|---|---|
| 10961101 | 2/1954 | France . | |
| 3300892 | 7/1984 | Germany | 241/195 |
| 3545708 | 6/1987 | Germany | 241/195 |
| 2168667 | 6/1986 | United Kingdom | 241/187 |

OTHER PUBLICATIONS

Database WPI Section PQ, Week 9102 Derwent Publications Ltd., London, GB; Class P41, AN 91-0134564 & SU, A, 1 544 484 (as UKR Casting Problems), 23 Feb. 1990 see abstract.

*Primary Examiner*—Timothy V. Eley
*Attorney, Agent, or Firm*—Merchant, Gould, Smith, Edell, Welter & Schmidt

[57] ABSTRACT

A hammer for mounting to and rotary movement by a rotor of a material reducing machine. The hammer is mounted at a first end portion thereof for free pivotal movement about an axis parallel to the axis of rotation of the rotor. A material engaging tooth extends radially outwardly from the second end portion thereof. In a preferred embodiment, the tooth is a rotary conical bit.

15 Claims, 7 Drawing Sheets

SWINGING HAMMER FOR A MATERIAL REDUCING MACHINE

BACKGROUND OF THE INVENTION

The invention relates to swinging hammers for material reducing machines and, more particularly, to a swinging hammer having an aggressive tooth for enhancing the operation and efficiency of a material reducing machine.

Changes in legislation and the scarcity of land suitable for use as landfills have led to an increase in the use of material reducing machines. Such machines are either of the forced feeding type or the gravity feeding type. In the forced feeding type, a conveyor is used to feed the input material into a rotating hammer mill or chipping rotor. Frequently, a hold-down mechanism is used to assist in the positive feeding of material into the hammer mill or rotor.

In the gravity feeding type, the hammer mill or rotor is positioned at the bottom of an open-topped container or tub. Material to be processed by the machine is dumped into the tub where gravity, perhaps assisted by oscillatory movement of the tub, will feed the material into the hammer mill or rotor.

To achieve a desired high output, and because of the wide variety of materials that must be processed by these material reducing machines, the hammer mills or rotors must be very heavily constructed to provide the necessary strength for effective operation and durability. Additionally, a heavy hammer mill or rotor will also have a large amount of angular momentum and energy to effectively process tough, high strength materials such as metals and also maintain a relatively constant rotational speed, resulting in less wear on the drive train and engine.

The heavy construction and severity of operating conditions have limited the variety of hammer designs that have been used. In forced feeding type material reducing machines, the cutting tools are typically fixed to the periphery with a rotating drum or disk. One problem associated with such machines is the loss or displacement of the chipping tools. Because of the high rates of rotation and impact energies, these displaced tools become high-velocity projectiles and are a serious safety concern. With forced-feeding type material reducing machines, however, the usual hold-down mechanism substantially overlies and covers the area from which such displaced tools would emerge. Additional shielding is easy to design into and build onto the machine to effectively contain any such displaced tools.

In gravity-fed machines, the containment for displaced cutting tools, or for high-velocity pieces of the materials being reduced, results from the walls of the tub and the volume of material filling the tub above the hammer mill. When the tub is close to empty, however, or if an open path to the exterior of the tub was otherwise extant, the possibility of a displaced tool or other high-velocity projectile being thrown out of the tub is possible. Heretofore, manufacturers have reduced this safety concern by using simple, block-shaped hammers that were generally larger in each principal dimension than a principal dimension of the materials being reduced. By using hammers lacking any narrow projecting portions, and avoiding add-on cutting tools, the likelihood of a catastrophic failure of a cutting member was greatly reduced.

Attempts have been made to improve the durability and efficiency of these block-shaped hammers. It is known, for example, to harden the edges of the tools with carbide. It is further known to shape a projecting leading edge on the hammer. Such hammers may either be asymmetrical, or of the common, reversible type having a profile known as bell-shaped. All such block-shaped hammers, even when hardened with carbide, have a relatively short surface life and a material reducing efficiency which falls off relatively quickly during use.

SUMMARY OF THE INVENTION

The invention consists of a swinging hammer for mounting to a rotor of a material reducing machine. The hammer has a body member that is mounted at a first end thereof to the rotor for free pivotal movement relative thereto. A tooth is attached to the body member at a second, opposite end portion thereof. The tooth projects radially outwardly and forwardly in the direction of rotation of the swinging hammer. In the preferred embodiment, the leading edge of the tooth projects forwardly of the center of mass of the swinging hammer but within the transverse confines of the body member. A rotary conical bit makes a suitable tooth member with greatly extended service life.

An object of the invention is to provide an aggressive tooth member on a swinging hammer for attachment to a rotor of a material reducing machine.

Another object of the invention is to provide a swinging hammer for material reducing machines having a greatly extended effective service life.

A further object of the invention is to provide a swinging hammer for material reducing machines having a cutting tool which is easily and inexpensively repaired or replaced.

These and other objects of the invention will be made apparent to a person of skill in the art upon a reading and understanding of this specification, the associated drawings, and appended claims.

DETAILED DESCRIPTION OF A PREFERRED EMBODIMENT

Figure 1:
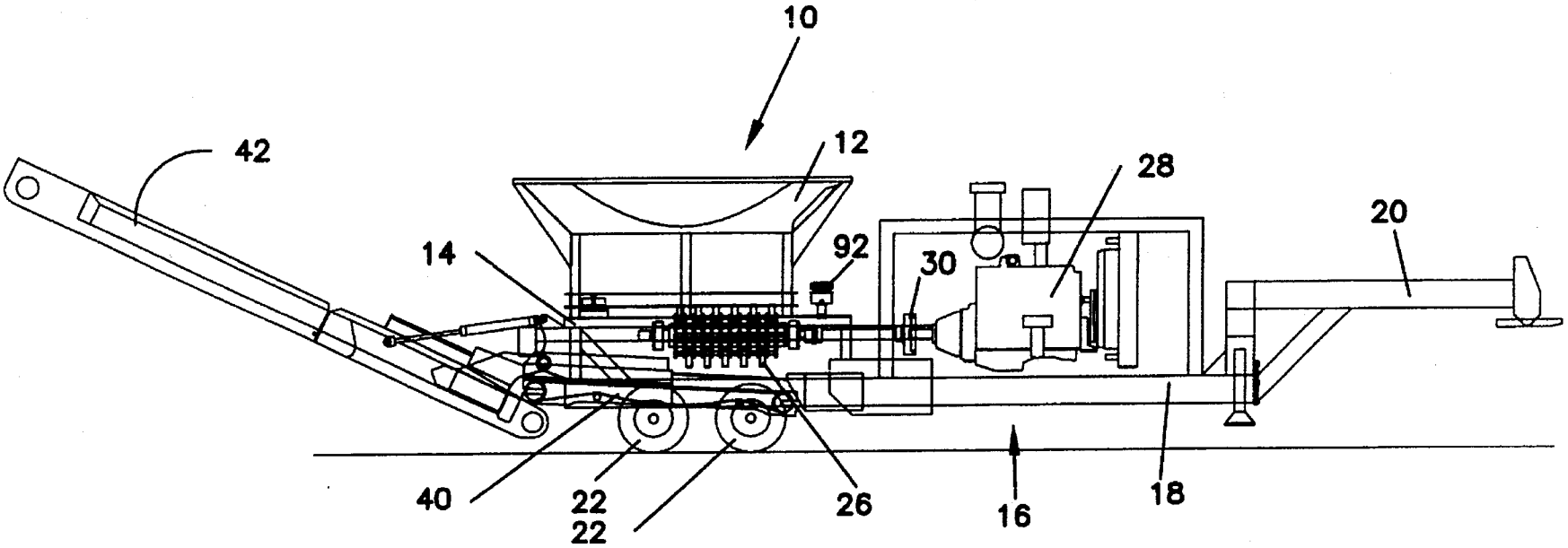
FIG. 1 is a side elevational view of a tub grinder material reducing machine on which the invention is used.

Illustrated in FIG. 1, generally at 10, is a tub grinder—type material reducing machine having an open-topped tub 12 mounted for rotation about a vertical axis on a table 14. The tub 12 and table 14 are supported on a trailer 16, including a main frame 18, a goose neck 20, and a set of wheels 22, that may be towed between work sites by a towing vehicle (not shown).

Figure 2:
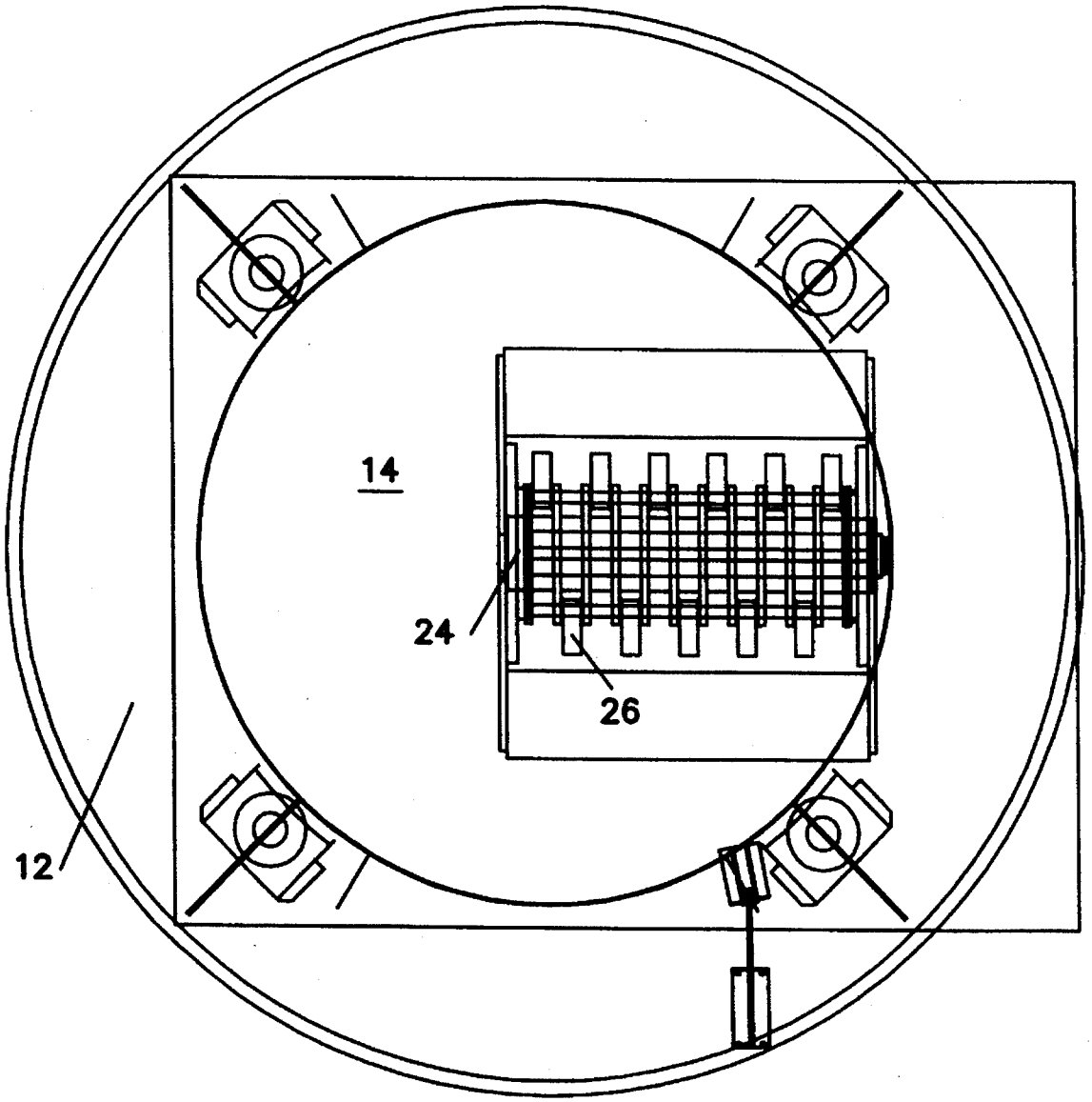
FIG. 2 is a top view of the tub grinder machine of FIG. 1.
Figure 3:
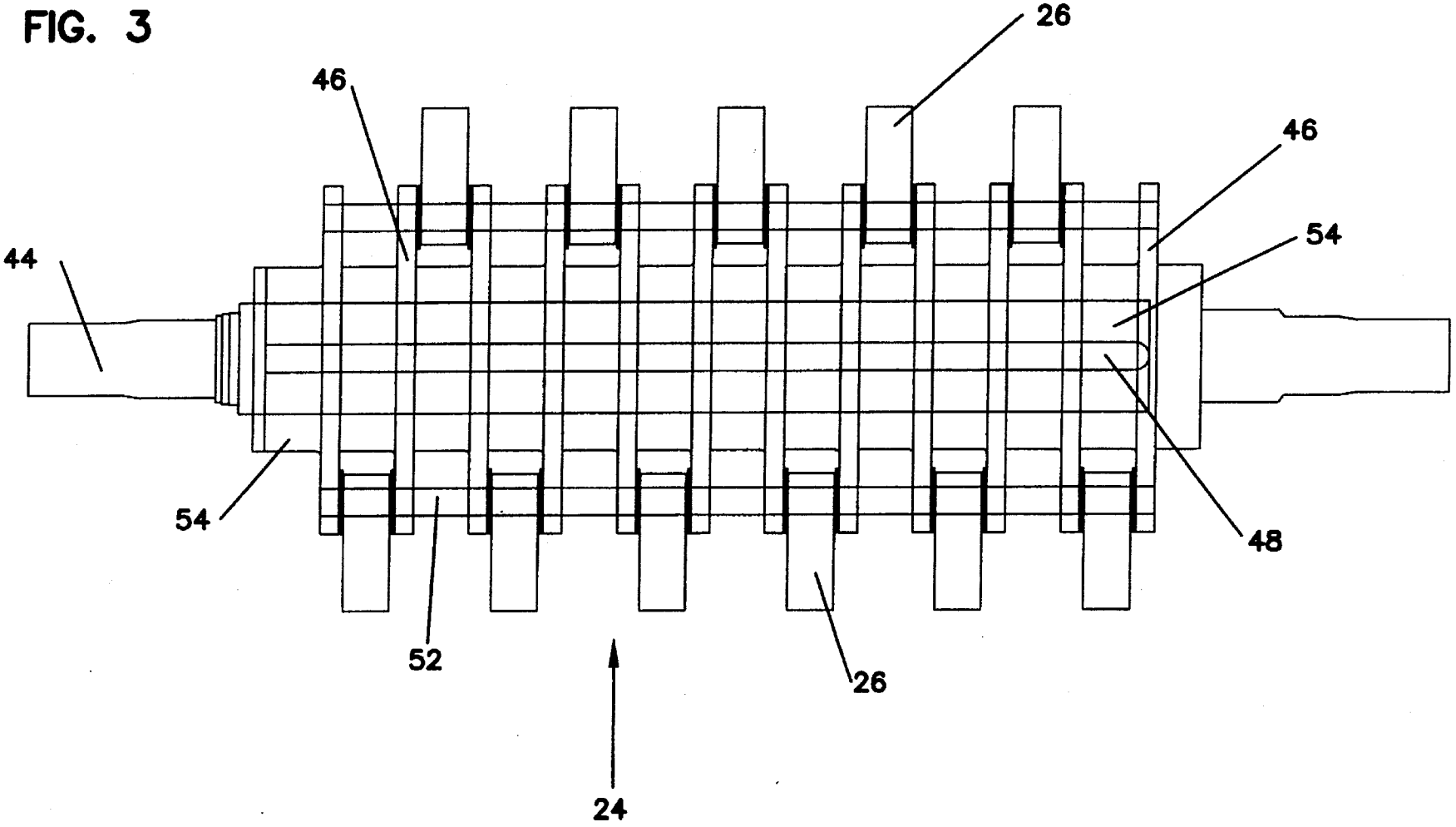
FIG. 3 is a side elevational view of a hammermill rotor on which is mounted a plurality of swinging hammers.

A rotor or hammermill 24 is mounted for rotation about a horizontal axis longitudinally aligned with the trailer 16 generally below the table 14. As will be described in detail below, the hammermill 24 includes a plurality of swinging hammers 26. (For ease of illustration, the swinging hammers of FIGS. 1–3 are of the block-shape of prior art hammers.) Upon rotation of the hammermill 24 by an engine 28 and drive 30, the swinging hammers 26 will extend radially, passing through an opening in the table 14 and thereby into the interior of the tub 12 (FIG. 2).

The hammermill 24 rotates partially inside a screen 32 (FIG. 4) which consists generally of an open-topped tube mounted to the bottom of the table 14. Material to be reduced in the tub 14 is contacted by the swinging hammers 26. The action of the swinging hammers 26, in cooperation with the screen 32, reduces the size of the material until it can pass through a plurality of openings 34 in the screen 32. An enclosure 36 surrounds the screen 32 and hammermill 24, containing the reduced materials exiting the screen 32, which then drop through an opening 38 at the bottom of the enclosure 36. A belly conveyor 40 is positioned below the opening 38 and conveys the reduced materials rearwardly to a folding conveyor 42 (FIG. 1) which further conveys the reduced material for deposit on a composting pile, a trash heap at a landfill, on a truck for transport to a remote location, or the like.

Figure 4:
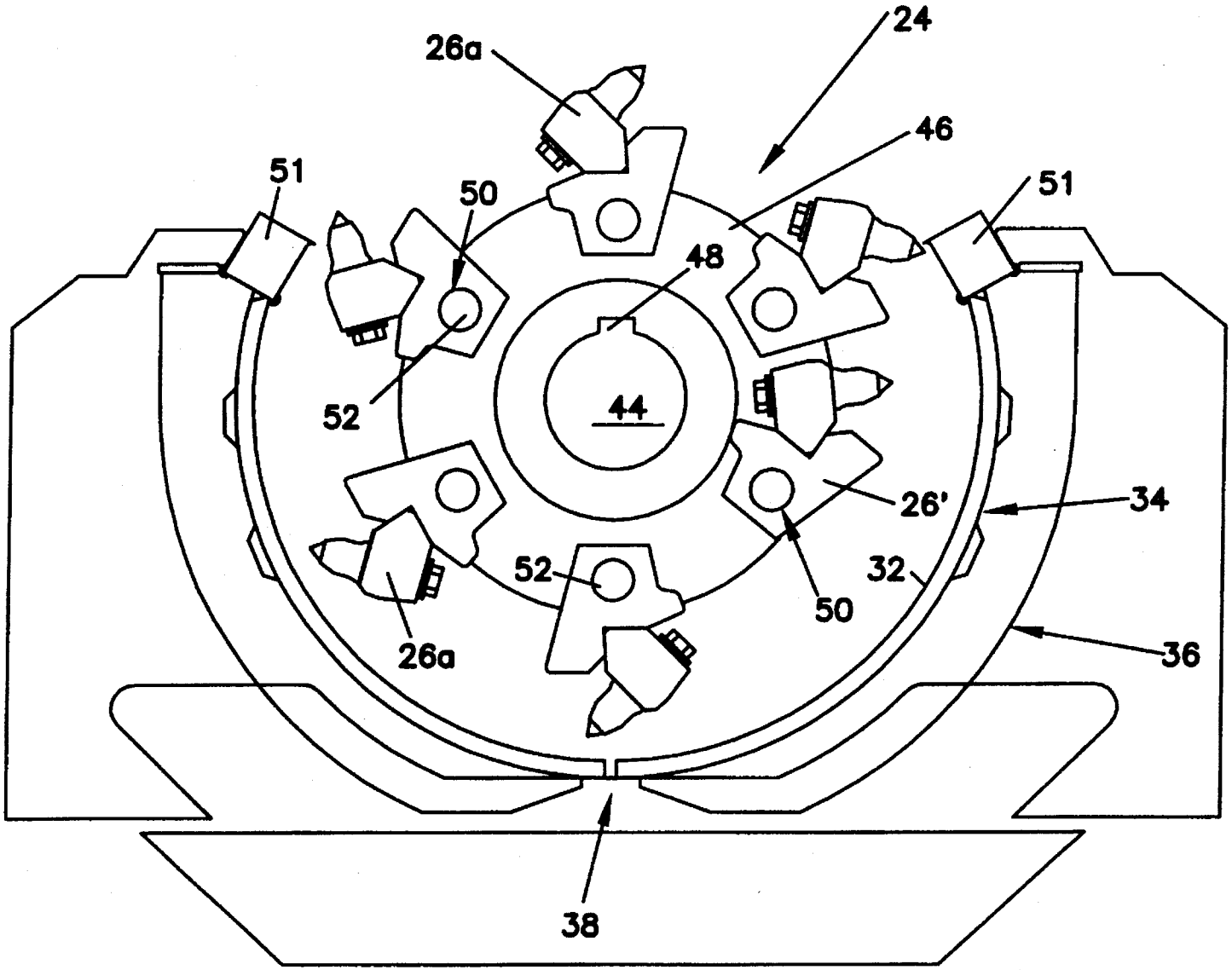
FIG. 4 is an end view of the hammermill rotor and an associated screen assembly.

In the preferred embodiment, the hammermill 24 has a main shaft 44 on which a plurality of plates 46 are received (FIG. 3). The main shaft 44 has a longitudinally extended key 48 which, in combination with a corresponding keyway in each plate 46 captures the plates 46 for rotation with the main shaft 44. The longitudinal spacing of the plates 46 on the main shaft 44 is established and maintained by a hub 54 associated with each plate 46. Each plate 46 is perforated by six uniformly spaced openings 50 (FIG. 4). The openings 50 in the plates 46 are aligned longitudinally and one of a set of six hammer-supporting shafts 52 is inserted through each of the six sets of aligned openings.

The plurality of swinging hammers 26 are mounted for free pivotal or swinging movement on the hammer-supporting shafts 52 in an alternating pattern. The hammers 26 can thus assume any pivoted position about its corresponding shaft 52 within its limits of motion as defined by contact of the hammer with the main shaft 44, as is illustrated by hammer 26' in FIG. 4. If the hammermill 24 is rotated in the absence of material in the tub 12, the hammers 26 will extend in a radial direction relative to the main shaft 44 with the axis of rotation of the main shaft 44, the axis of pivotal movement of each individual hammer 26, and the center of gravity of the hammer 26 all in a common plane.

Figure 6:
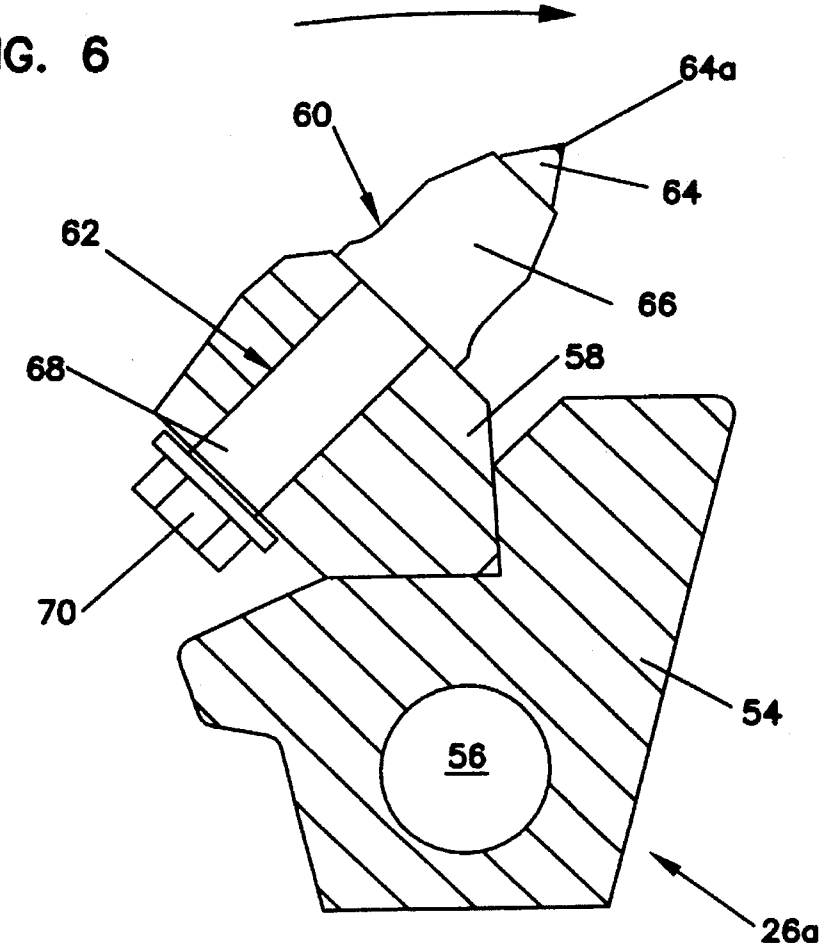
FIG. 6 is a cross-sectional view of a second swinging hammer of the present invention.

A swinging hammer **26*a* of the present invention is illustrated in FIG. 6, and includes a hammer main body member 54 having a throughbore 56 in a first end portion thereof for mounting of the hammer 26*a* on a corresponding one of the hammer-supporting shafts 52 of the hammermill 24 as described above. Also included is a pocket body member 58 which is secured to an opposite, second end portion of the main body member 54 by weldments or the like. A rotary conical tooth 60 is mounted inside a cylindrical pocket 62 of the pocket body member 58. The rotary tooth 60 has a hardened conical leading face 64 which projects forwardly of a tooth holding member 66 that is secured to a first end portion of a shaft member 68. A cap 70 is threadably secured to the shaft member 68, being tightened in abutment with a flange on the second end portion of the shaft member 68. The cylindrical pocket 62 is shorter than the shaft member 68 so that the tooth 60 is free to rotate inside the pocket body member 58. In the preferred embodiment shown in the drawings, bodies 54, 58 and 60 are sized and positioned for a tip 64*a* of the leading end to project past a line defined by the axis and center of gravity of the hammer 26*a* when the hammer 26*a* extends radially from the hammermill 24 during rotation of the mill 24. Further, these elements are mutually aligned and sized for the tip 64*a* to clear, in close tolerance, a breaker bar 51 as the mill 24** rotates.

Figure 5:
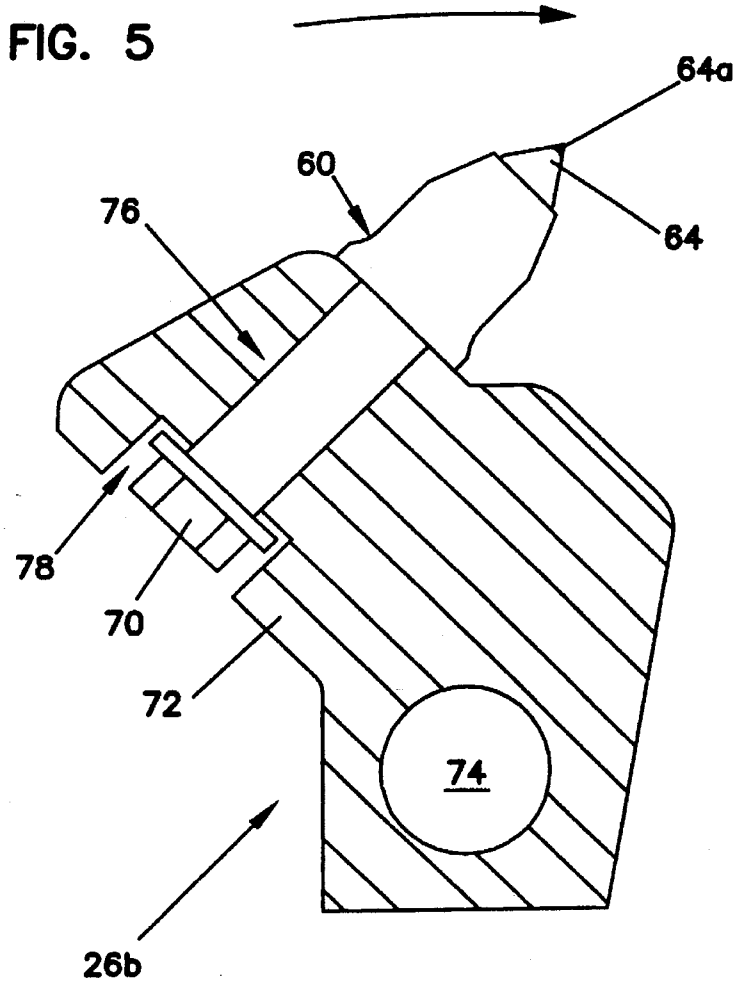
FIG. 5 is a cross-sectional view of a first swinging hammer of the present invention.
Figure 7B:
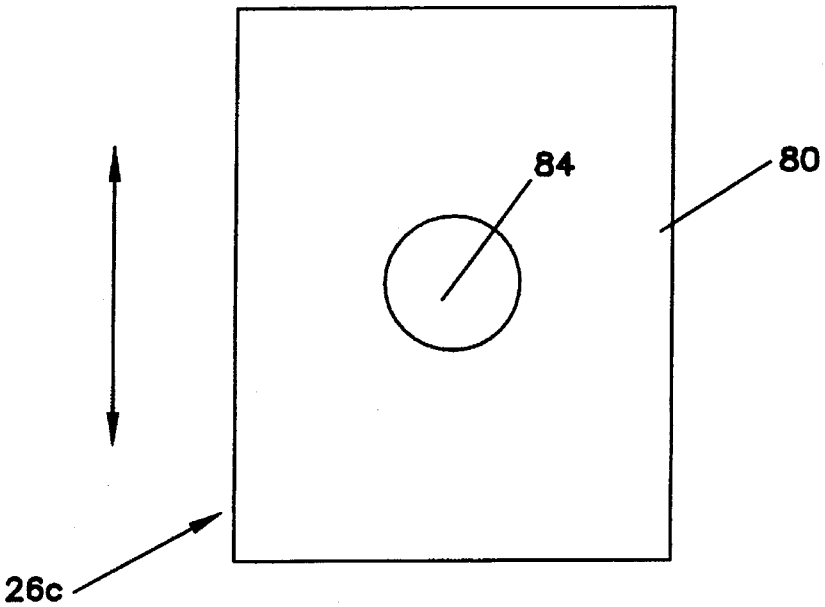
FIGS. 7*a* and 7*b* are a front elevational view and a top view of a third swinging hammer of the present invention.
Figure 7A:
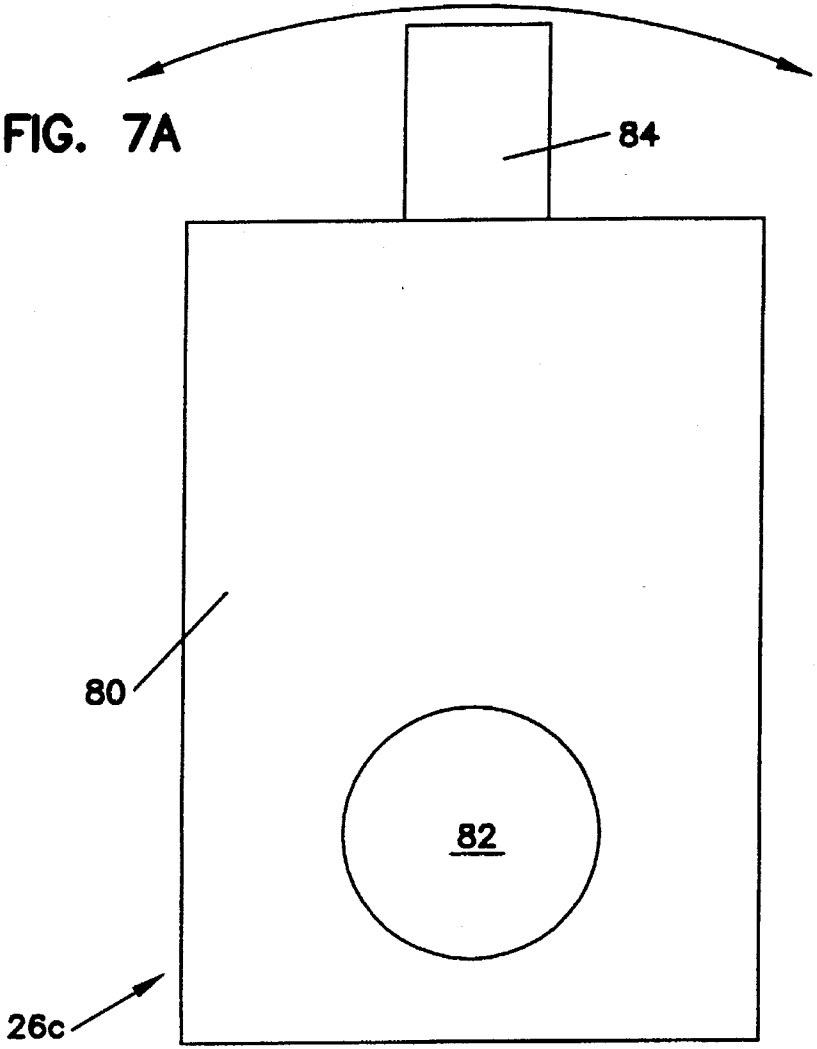

An alternative swinging hammer structure **26*b* is illustrated in FIG. 5. A body member 72 is again perforated at a first end portion thereof by a throughbore 74 for free pivotal movement of the hammer 26*b* when attached to the hammermill 24. The opposite end portion of the body member 72 forms a pocket for holding a rotary conical tooth 60, including a cylindrical sleeve 76 and a cap pocket 78. The cap 70 of the tooth 60 is inside the cap pocket 78** and thus in a more protected position against contact with the material being reduced.

Figure 8B:
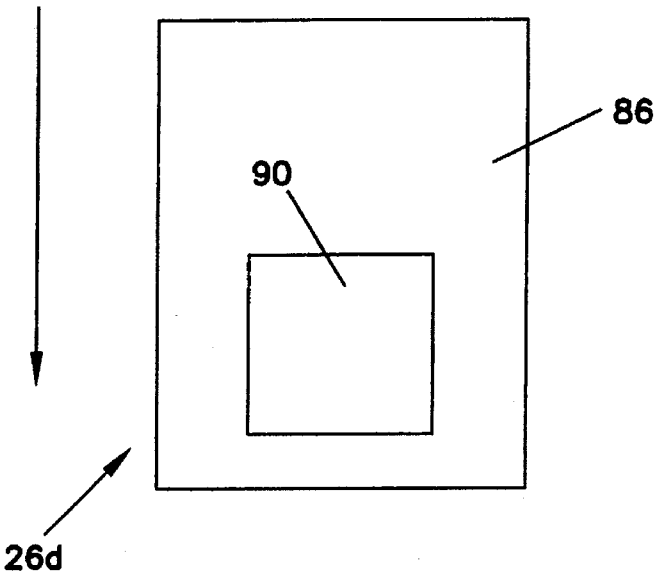
FIGS. 8*a* and 8*b* are a front elevational view and a top view of a fourth swinging hammer of the present invention.
Figure 8A:
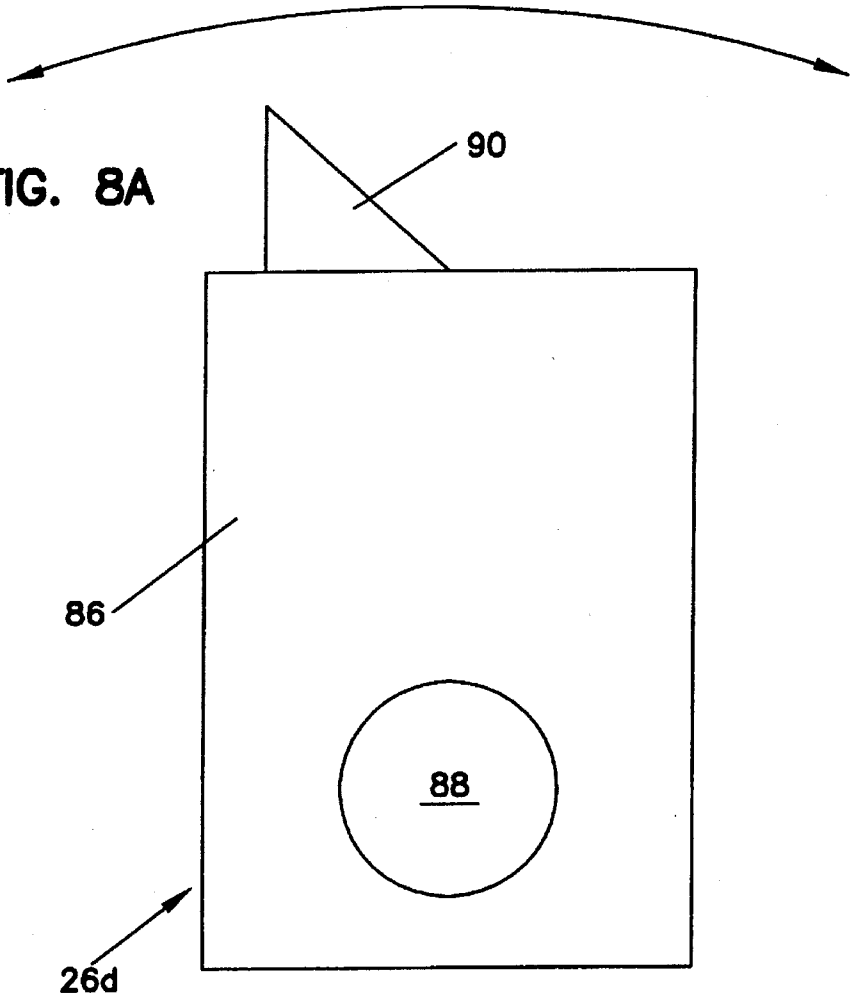

Other embodiments of the swinging hammers of the present invention are illustrated in FIGS. **7*a*, 7*b* and 8*a*, 8*b* at 26*c* and 26*d*, respectively. Swinging hammer 26*c* has a body member 80 that is perforated at a first end portion thereof by a throughbore 82. An upright, cylindrical tooth member 84 extends outwardly from the second end portion of the body member 80. Swinging hammer 26*d* (FIGS. 8*a* and 8*b*) has a body member 86 that is perforated at a first end portion thereof by a throughbore 88. A wedge-shaped tooth member 90 extends outwardly and forwardly from the second end portion of the body member 86**.

Each of the hammers **26*a–d*, accordingly, has a tooth which projects radially outwardly relative to the body member of the hammer. Further, as mounted on the hammermill 24, the hammers 26*a–d* are rotated by the hammermill 24 in the direction of the arrows in FIGS. 5–8, respectively. The tooth of the hammers 26*a*, *b* and *d*, therefore, also projects forwardly in the direction of rotation of the hammermill 24. Although the tooth member 84 of swinging hammer 26*c* does not project forwardly, the hammer 26*c* can be reversibly mounted on the hammermill or the hammermill rotation can be reversed with equal effectiveness of the swinging hammer 26*c***.

The body members of the hammers **26*a–d* are of a width generally corresponding to the width of the block-shaped hammers of the prior art. The present invention contemplates the addition of a tooth member extended radially outwardly from the body member and having a leading face which has substantially less surface area than the leading face of block-shaped hammers thus improving the breaking and splintering action of the hammers on impact with the material being reduced. Further, if the tooth member is also projected radially outwardly and forwardly in the direction of rotation, as in the preferred embodiment hammers 26*a*, *b* and *d*, the hammer will have a material gathering action as well which will improve the feeding of material into the material reducing areas of the hammermill. Both of these features greatly improve the throughput capacity of the tub grinder 10, and reduce problems such as bridging of material in the tub 12 (FIG. 1**).

The rotary teeth 60 are positively retained on the hammers **26*a* and 26*b* by being held in a surrounding pocket and having the retention member or cap 70 in a shielded position (FIGS. 5 and 6). In the preferred hammers 26*a* and 26*b*,** further, the tooth member is allowed to rotate in the pocket and may resist undesirable displacement better by yielding to twisting forces. A rotary conical tooth will also be self-sharpening for an improved service life.

In the preferred hammers **26*a* and 26*b*, the rotary conical tooth 60 has been set approximately at an angle to the line of the hammer passing through the center of its throughbore and the center of gravity of the hammer that corresponds to the conical angle of the leading face 64. While an angle of between about 45° and 50° is preferred for a rotary bit having a conical angle of 45°, it is not believed that these angles are critical to the effective operation of the hammers 26***a* and 26*b*.

Additionally, the tooth member can be set at an oblique angle to the plane of rotation of the hammer so that the leading face of the tooth member is splayed and may extend beyond the width-wise confines of the body member. Hammers with tooth members at differing splay angles can be arranged on the hammermill in an alternating pattern to further increase the efficiency of the tub grinder.

In the specific tub grinder 10 illustrated in FIG. 1, the engine 28 is rated at 420 H.P. at 2,100 r.p.m. The drive 30 is direct power-take-off (PTO) with a torque limiter (5,056 ft./lb. max.) and a triple disk clutch. The hammermill 24 has a twenty-seven inch swing tip diameter and includes thirty-three swinging hammers 26. The hammermill is typically rotated at a speed of 2,100 r.p.m. The swinging hammers 26*b* have body members 2½ inches wide and are 7⅜ inches long.

The tub 12 is rotated by a tub drive, indicated in FIG. 1 generally at 92, for improving the feeding of material into the hammermill 24. A speed sensing control reverses the rotational direction of the tub 12 if the rotational speed of the hammermill 24 drops below 1,650 r.p.m. and resumes its feeding rotation when the rotational speed returns to 2,100 r.p.m.

In the specific tub grinder 10 described above, tests indicate that using swinging hammers 26 improves the throughput of the tub grinder 10, over block-shaped hammers of the prior art, by between about twenty and more than four hundred percent depending on hammer design and the length of service, with the percentage improvement increasing generally with longer service lives.

Although the invention has been described with respect to a preferred embodiment thereof, it is to be also understood that it is not to be so limited since changes and modifications can be made therein which are within the full intended scope of this invention as defined by the appended claims.

We claim:

1. A hammermill comprising:

a main shaft rotatable about a main axis passing longitudinally through the main shaft;

a plurality of hammers swung by the main shaft, at least one of the hammers including;

a body member having a first end and a second end, the first end being pivotally connected to the main shaft at a pivot axis parallel to and spaced from the main axis; and a conical tooth member extending radially outward from the second end of the body member, the conical tooth member including a hardened tip which faces a direction of rotation of the main shaft about the main axis, the conical tooth member having a longitudinal axis forming an oblique angle with respect to a line extending from the pivot axis generally through a center of gravity of the hammer.

2. The hammermill of claim 1, wherein the hardened tip of the conical tooth member is disposed forward toward the direction of rotation from the line defined by the center of gravity of the hammer and the pivot axis.

3. The hammermill of claim 1, wherein the conical tooth member is rotatable about the longitudinal axis.

4. The hammermill of claim 1, wherein the conical tooth member is removably connected to the body member.

5. The hammermill of claim 1, wherein the tooth member includes:

a tooth shaft extending along the longitudinal axis through a sleeve defined by the body member, the tooth shaft having a first end and a second end;

a tooth holding member connected to the first end of the tooth shaft;

a hardened conical leading face connected to the tooth holding member, the leading face forming the hardened tip of the tooth member; and a retaining member connected to the second end of the tooth shaft.

6. The hammermill of claim 5, wherein the retaining member comprises a cap threadingly engaging the second end of the tooth shaft.

7. The hammermill of claim 6, wherein the cap fits within a protective pocket defined by the body member.

8. A tub grinder comprising:

a tub having walls defining an interior and a floor having an opening;

a grinding mill disposed at least partially exposed through said opening, said grinding mill including;

a shaft mounted for rotation about a main axis;

a plurality of hammers secured to said shaft for rotation therewith, each of said hammers including a body member having a first end and a second end, said first end connected to said shaft at a pivot axis parallel to and spaced from said main axis and said second end having an impact pin set with a longitudinal axis of said pin at an oblique angle with respect to the body member of the hammer, said pin including an impact end facing a direction of rotation of said shaft about said main axis.

9. A grinder according to claim 8, wherein each of said pins is individually removably mounted to said hammermill.

10. A grinding mill according to claim 8, wherein said pin is mounted to said hammermill with said pin rotatable about said longitudinal axis.

11. A grinder according to claim 8, wherein said impact end is disposed forward of a center of gravity of said hammer in a direction toward said direction of rotation.

12. A tub grinder comprising:

a tub having walls that define an interior volume and having a floor defining an opening;

an upwardly curved screen positioned below the opening in the floor of the tub;

a hammermill extending across at least a portion of the opening in the floor of the tub, the hammermill including a shaft rotatable about a main axis passing longitudinally through the shaft, the hammermill also including a plurality of hammers which are swung by the shaft, at least one of the hammers including;

a body member having a first end and a second end, the first end being pivotally connected to the shaft at a pivot axis parallel to and spaced from the main axis; and a conical tooth member extending radially outward from the second end of the body member, the conical tooth member including a hardened tip which faces a direction of rotation of the shaft about the main axis, the conical tooth member having a longitudinal axis forming an oblique angle with respect to a line extending from the pivot axis generally through a center of gravity of the hammer.

13. The hammermill of claim 12, wherein the hardened tip of the conical tooth member is disposed forward toward the direction of rotation from the line defined by the center of gravity of the hammer and the pivot axis.

14. The hammermill of claim 12, wherein the hardened tip of the conical tooth member passes in close proximity to the screen as the shaft is rotated about the main axis.

15. The hammermill of claim 12, further including a pair of blocker bars affixed to the screen, wherein the hardened tip of the conical tooth member passes in close proximity to the blocker bars as the shaft is rotated about the main axis.

* * * * *